US007000542B2

(12) United States Patent
Hecht

(10) Patent No.: US 7,000,542 B2
(45) Date of Patent: Feb. 21, 2006

(54) LOW COST LITHO PRINTING PRESS, PRINTING PLATE, AND METHOD FOR PRINTING PASTE-TYPE OIL-BASED LITHO INK WHICH ELIMINATE THE DAMPENER AND DAMPENING SOLUTION THEREFROM

(76) Inventor: Myer (Mike) H. Hecht, 1429 Central Ave., Deerfield, IL (US) 60015

( * ) Notice: Subject to any disclaimer, the term of this patent is extended or adjusted under 35 U.S.C. 154(b) by 0 days.

(21) Appl. No.: 10/722,816

(22) Filed: Nov. 26, 2003

(65) Prior Publication Data

US 2005/0109227 A1 May 26, 2005

Related U.S. Application Data

(60) Provisional application No. 60/430,262, filed on Dec. 2, 2002.

(51) Int. Cl.
*B41F 7/00* (2006.01)
*B41N 1/14* (2006.01)
*B41N 3/00* (2006.01)

(52) U.S. Cl. ..... 101/450.1; 101/453; 101/463.1; 101/401.1; 101/395

(58) Field of Classification Search ..... 101/395, 101/401.1, 375, 376, 217, 178, 181, 183, 101/490, 492, 141, 142, 450.1, 453, 463.1
See application file for complete search history.

(56) References Cited

U.S. PATENT DOCUMENTS

| | | | | |
|---|---|---|---|---|
| 3,204,557 | A * | 9/1965 | Harris | 101/492 |
| 4,056,056 | A * | 11/1977 | Giori | 101/152 |
| 4,481,282 | A * | 11/1984 | Obata et al. | 430/303 |
| 5,630,363 | A * | 5/1997 | Davis et al. | 101/141 |
| 5,638,752 | A * | 6/1997 | Hartung et al. | 101/177 |
| 5,771,809 | A * | 6/1998 | Hecht | 101/401.1 |
| 6,044,761 | A * | 4/2000 | Hecht | 101/395 |
| 6,283,030 | B1 * | 9/2001 | Fromson et al. | 101/465 |

* cited by examiner

*Primary Examiner*—Leslie J. Evanisko

(57) ABSTRACT

A litho printing press comprising one or more litho ink printing stations, each of which has paste-type, oil-based litho ink applicating means for depositing said oil-based litho ink onto a printing plate, an adjacent first rotatable cylinder called the plate cylinder on which is clamped a non-planar, laminate multiple layer flexible printing plate which receives said oil-based litho ink from the ink applicator means in a nip therebetween, and at least a second rotatable cylinder called the impression cylinder over which passes the substrate to be printed upon in a nip between the substrate and either the plate cylinder or another and intermediate rotatable cylinder called the blanket cylinder. This results in elimination of dampener and the dampening solution. The non-planar multiple layer flexible printing plate has an outermost layer for receiving the litho ink after it has been adhesively secured in the pre-press department of the printing plant to an innermost layer of a different material. The outermost layer is a see-through translucent or transparent synthetic plastic. The different material of the innermost layer can be either a synthetic transparent plastic or an imaged metal plate. In the pre-press department of the printing plant the outermost layer is cut through to the innermost layer manually or by a CAD-CAM machine to provide spaced cut-out areas with adjacent projections which receive the oil-based litho ink and then deposit said ink directly or indirectly on a substrate. The elimination of the dampening solution and the dampener from the print station by the non-planar laminate multiple layer flexible body printing plate, called a "Mike Plate" or "Modified Mike Plate" clamped on the plate cylinder makes possible a litho printing press without a blanket cylinder. That is, a litho printing press with only two cylinders per print station instead of three, and wherein said "Mike Plate" or "Modified Mike Plate" clamped on the plate cylinder prints directly upon the substrate, sheetfed or webfed. All this is done at low cost with less downtime on-press, and with significantly less waste and spoilage and other attendant benefits all of which contribute to quicker delivery of jobs by the printer to his customer.

24 Claims, 2 Drawing Sheets

LOW COST LITHO PRINTING PRESS, PRINTING PLATE, AND METHOD FOR PRINTING PASTE-TYPE OIL-BASED LITHO INK WHICH ELIMINATE THE DAMPENER AND DAMPENING SOLUTION THEREFROM

RELATED APPLICATION

This application is based on Provisional Application Ser. No. 60/430,262 filed Dec. 2, 2002.

BACKGROUND OF INVENTION

A printing press is basically a sequence of a series of nips, created at the contact of opposing rotating cylinders, with voids on the printing plate to insure no ink will be deposited on the substrate where it is not wanted. The number of nips in a printing press determines the simplicity/complexity of the printing process. The surface characteristics of the applicator(s) of the ink from one surface to another in the nip(s) determines how much of the ink gets transferred from and how much remains on the applicator. Seldom, if ever, does all the ink on an applicator get transferred to its recipient surface at the points of contact in the nip. In the printing trade, this is known as the ink film split in the nip, or simply ink film split, or film split.

The four major printing processes transfer ink—typically a pigmented liquid capable of becoming a colored film on a substrate when dry—in paste or fluid consistency, from an applicator, known as the printing plate, securely mounted on a rotatable cylinder, onto another surface in a nip created with another, opposing, rotatable cylinder. The ultimate deposition of the ink, directly or indirectly, is onto a substrate—paper, paperboard, plastic, plastic coated paper/paperboard, foil-laminated paper/paperboard, vacuum-metalized paper/paperboard, etc.—held securely on a rotatable, opposing cylinder, known as the impression cylinder, in a nip.

I. In letterpress printing, the original printing process pioneered by Johann Gutenberg in Germany in the $16^{th}$ Century, the printing plate is made of a single layer of metal with ink-containing projections which transfer the ink directly onto the substrate which forms the final product from the raised portions of the printing plate.

Typically, letterpress ink is a paste-type with little or no solvent. In a sheet fed operation, there is no auxiliary inter-station drying equipment. Thus, in multi-color letter presses, the various colors of the ink are still wet when the substrate arrives at the next print station from the previous print station. Frequently, the ink on the sheets in the delivery pile is still not dry, so some holding of piles (lifts) after they have been taken off the press is necessary before the sheets thereon can go to the next operation for further processing into a finished product.

II. In flexographic printing, known as flexography, the printing plate also transfers the ink on it directly onto the substrate, also forming the final product, from raised portions thereof, typically molded rubber or plastic.

In flexo, the printing plate is typically a single layer of a plastic material with ink-receiving projections. Typically the ink is fluid. That is, it contains a significant amount of solvent, which does not become part of the dried ink film. Typically, the amount of solvent is more than the ink vehicle and pigment combined, often two or three times as much. Originally, and still mainly today, the solvent is a volatile organic compound (VOC), although water is now used instead of solvent on some substrates, primarily paper and paperboard. Typically, this solvent or water is driven off the substrate in commercial and folding carton printing by interstation and end of press auxiliary drying equipment. Thus, flexo ink typically is dry when the substrate arrives at the next print station from the previous print station. Typically, there is no auxiliary drying equipment interstation or end of printing press on corrugated paperboard substrates, because its print surface is quite porous. Here, a substantial amount of the ink sinks beneath the surface. Thus, here the ink dries by the combination of absorption and ambient solvent evaporation. Whatever the surface, however porous or non-porous it may be, the solvent or water (which holds the ink vehicle and pigment in suspension—i.e., in emulsion) does not become part of the dry ink film on the substrate.

Because all the colors of flexo ink are dry when the printing is finished, the printed substrate is ready to go to the next operation without holding. Indeed, because all the ink is dry, subsequent operations on the substrate, such as embossing, perforating, cutting, creasing, folding, gluing, binding, can be done in-line on the printing press. In-lining has economic advantages.

In both letterpress and flexo printing, there are a total of two nips: (1) ink from a fountain roller or rollers onto the raised portion of the printing plate; (2) ink from the raised portions of the printing plate onto the substrate, in a nip with the impression cylinder.

III. Rotogravure printing—gravure for short—like letterpress and flexo—transfers the ink from every print station directly onto the substrate. However, in contrast to letterpress and flexo, gravure ink is deposited directly onto the substrate from depressions in the printing plate, or directly from the printing cylinder, typically created by an etching (engraving) process. These depressions are called cells. The cubic capacity of the cells determines the amount of ink therein, and the amount of ink deposited on the substrate. As in letterpress and flexo, there are a total of two nips, ink roller(s) to plate on the plate cylinder, plate to substrate on the impression cylinder.

Typically, the ink in gravure printing is fluid, as in flexo, typically with a high percentage of solvent, which typically is driven off the substrate by auxiliary interstation and end of press drying equipment. Thus, as in flexo, no holding is necessary before the substrate can go the next operation. Thus, as in flexo, in-lining for subsequent operations is possible.

As in letterpress and flexo, typically ink does not cover the entire form. There are some voids, because typically the printed form has some voids. As in letterpress and flexo, there are a total of two nips.

IV. Lithographic (offset) printing, unlike letterpress and flexo or gravure, utilizes a planar printing plate, i.e. one that has no raised or recessed surfaces. This 1-level printing plate distinguishes it from all other print processes and creates complexities and issues to contend with, not inherent in all other print processes.

One consequence of the planar litho printing plate is that currently litho printing is indirect—in contrast to the foregoing 3-print processes. Thus, the planar litho plate transfers the ink that is on it onto a composite rubber/fabric material called a blanket, mounted securely on a separate cylinder, called the blanket cylinder, in its own nip. It is this rubber/fabric blanket, which then transfers the ink on it onto the substrate securely held on the impression cylinder, in another nip. Thus, the derivation of the word offset to describe the litho process and printing press.

How is the paste-type litho ink kept off the voids where ink is not wanted/needed? The typical, rather thin (compared to letterpress) metal printing plate in litho printing, is chemically treated in the image areas to make it water-repellant in a department of the printing plant called pre-press, or more commonly, the plate room. This chemical treatment of the image areas of the metal planar plate is designed to keep water off the image areas. Keeping ink off the non-image (i.e., void) areas is achieved by a water-based fountain solution—typically water with a wetting agent/agents, whose purpose is to make water wetter—which is applied to the planar printing plate from a fountain on a print station in its own nip, prior to the application of ink from its fountain onto the printing plate in its own nip. It wets the non-imaged areas (to keep ink off), but not the imaged areas.

The indirect transfer of the litho ink on the planar printing plate, and the introduction of a water-based fountain solution onto the printing plate prior to the deposition of ink thereon, makes the current litho process more complex and difficult in maintaining print fidelity and color consistency throughout a run, than the other three major print processes.

In the current planar litho printing plate process, with its indirect transfer of ink onto the substrate, there are four nips versus two for the other three print processes. It is a truism, the more nips in a print process, the more chances for something to go awry and the more press-intensive it is for the press crew to manage the operation to consistently produce saleable product with least waste and press downtime, with least chance of rejection by the customer for color variation.

In the litho industry, the color variation and deviation from spec and initial color okay is attributed to ink emulsification, or ink/water imbalance. It is the pressman's nightmare. It causes him to go hopping around 4-5-6-7-8-9-10 printing press stations to make a move or moves on the various print stations to bring the ink and fountain solution back into balance on each print station.

The color variation from spec and color okay at the beginning of the run is the major cause of waste and press downtime on whatever the substrate, on whatever make or size of litho press employing planar printing plates.

SUMMARY OF INVENTION

The preferred form of my invention involves the unobvious new use of a 3-layer laminate body comprising of two separate, disparate materials joined together by an adhesive (the third layer), disclosed in my U.S. Pat. No. 5,771,809 issued in 1998 only for use as a means for applying coating materials onto selected areas of an already printed substrate. Before the present invention, I never thought of using this laminate body as a special printing plate initially for only printing large areas much larger than individual letters, like relatively large areas forming elongated, square, circular or other shaped areas over which, if desired, letters of a desired size would be printed in a conventional way at a different regular printing station. I now recall that 40–50 years ago a one-piece raised surface printing plate had been used on a litho press. This one-piece raised printing plate was a photo-polymer plastic material made by the duPont Company, trade named DYCRIL.

My coating plate disclosed in the aforementioned USA Patent preferably is a flexible, all-plastic 3-layer laminate body which can be wrapped around and secured to a rotatable cylinder, typically on a flexo unit mounted after the last print station of a litho printing press. It is not a part of the litho print process.

The 3-layer laminate body is comprised of a preferably transparent inner carrier layer to which is adhered a preferably translucent or transparent outer application layer of a different plastic material than the carrier. The adhesive, the intermediate layer, which adheres the inner carrier layer to the outer application layer is preferably a pressure-sensitive adhesive which presently comes from the factory to the printing plant on the bottom side of the outer application layer. Generally, the coating-applying layer, referred to as the applicator layer, initially is a continuous layer, but which is cut away in those areas where no coating material is to be applied, and disposed of.

My new invention unobviously uses this or a similar body as a (non-planar) raised printing plate surface made preferably of inexpensive plastics or other material in contrast to the expensive one-piece photo-polymer plastic material used forty or fifty years ago. This raised surface preferably transfers most of the ink on its raised portions to a printing blanket and then from the blanket to the substrate. While the carrier and applicator layers are preferably transparent or translucent so that the applicator layer can be manually cut using a cut-pattern on a sheet placed under the carrier layer in pre-press, other cutting techniques which automatically control the cutting edge involved make the use of a cut-pattern on a sheet (i.e., a template) underneath unnecessary. I discovered this unique, low-cost, multi-layer printing plate, which can be put together in the pre-press department of the printing plant with standard pre-press equipment and procedures, or with a programmable computer-operated machine with a cutting edge (which is called a CAD-CAM in the printing trade). I call this low-cost, multi-layer printing plate the "Mike Plate." It can be used as the printing plate in a litho or flexo press.

As a practical matter, my low cost non-planar, 3-layer laminate printing plate must be durable to withstand the rigors of each print station for long runs and/or reruns. Also, the surface characteristic of the raised applicator portion of my raised printing plate, which contacts the blanket in the printing plate/blanket nip, must be such that it transfers much, and preferably most, of the ink on it onto the blanket. In other words, during the ink film split in the nip, only a small/modest amount of the ink should remain on the printing plate applicator as the cylinder it is on rotates back to the ink fountain.

Critical to the acceptance of my "Mike Plate" by the litho printing industry is the combination of its low material cost, of readily available materials, and its ease of creation in the pre-press department of the printing plant.

The salient characteristics of the "Mike Plate" applicator are: (1) its ability to deposit much/most of the ink on it into the blanket for subsequent transfer to the substrate; (2) ease of mounting/adherence to the carrier; (3) smash resistance on press; (4) ease and speed of replacement if any portion gets damaged on press; (5) low cost. I have found 0.020" EZ-LAC, a commercially available translucent plastic with a 0.001" pressure-sensitive adhesive on the back side thereof, most desirable.

If the printer selects rather thin imagable metal as the carrier, his pre-press department will image the metal in standard fashion with the imaging equipment and chemicals it normally uses. The imaged metal now serves as the template for the positioning of the EZ-LAC thereon, in accordance with the form. In this procedure, plate-imaging chemicals are used. These bear a cost and have a disposal limitation based on ecological considerations. This procedure also involves an extra operation compared to the transparent polyester material as the carrier.

The more cost-conscious and environmentally concerned printer—call him the more attuned corporate citizen—will not use imagable metal and imaging hazardous chemicals. He should preferably select 0.010" transparent polyester—e.g., duPont's MYLAR—as his carrier. Underneath this, he will properly position a patterned film for the form. Thus, the patterned film becomes the template for the form. It enables the pre-press employee to precisely position the 0.020" EZ-LAC, preferably with its 0.001" adhesive, on the transparent polyester plastic in the image areas, or over the entire form and then cut and strip off the EZ-LAC in the non-image areas. Thus, in this procedure no imaging chemicals and no special disposal considerations are involved, with the attendant bonus of lower material and processing costs.

Whichever carrier is used, with a "Mike Plate" there is now only three nips involved in getting ink from the ink fountain rollers onto the substrate, versus four in conventional planar litho plate, because the fountain solution roller and its nip with the printing plate is now eliminated. This lesser number of nips almost automatically reduces the number of things that can go wrong on press. Thus, there is no fountain solution to intrude into every color's ink on the press. A major cause of color variation is thus eliminated.

The low cost of the materials comprising the heterogeneous 3-layer "Mike Plate," coupled with its quick, in-plant-making advantage and short lead times, plus easy, low-cost quick remakes when necessary, represent its go/no-go superiority over yesteryear's DYCRIL.

An important benefit of "Mike's Method" and its 3-layer "Mike Plate" for ink deposition on a litho press is the maintenance of ink color strength and consistency throughout a run, whatever its length, on each of the multiple print stations. The accompanying maintenance of initial densitometer reading and initial color okay on each color of the form, with minimum action/adjustment by the pressman is a big plus. It takes many monkeys off the pressman's back and significantly reduces waste and press downtime. It makes possible the running of more jobs profitably, in any time frame. This connects directly to just-in-time delivery needs, customer satisfaction and the bottom line.

Yet another and major benefit to be derived from the elimination of fountain solution from the litho process, is the potential elimination of the need for indirect printing. The absence of the fountain solution and its nip makes possible the elimination of the blanket cylinder. Elimination of the blanket cylinder significantly simplifies the design and construct of any litho press, with the attendant lower cost it permits for the same number of press stations.

A direct printing litho press should also maintain color consistency better, with attendant less waste and press downtime, with their contribution to the printer's bottom line.

Observant and thinking, letterpress, flexo, and gravure printers will consider the use of a "Mike Plate" for their presses. Elimination of water is not involved here. But lower costs, the achievement and maintenance of densitometer readings with less ink and rather simple in-plant plate making will be facilitated. Savvy webfed litho printers also will see the advantage of using a "Mike Plate" to eliminate fountain solution on their presses.

DETAILED DESCRIPTION OF DRAWINGS

Figure 1:
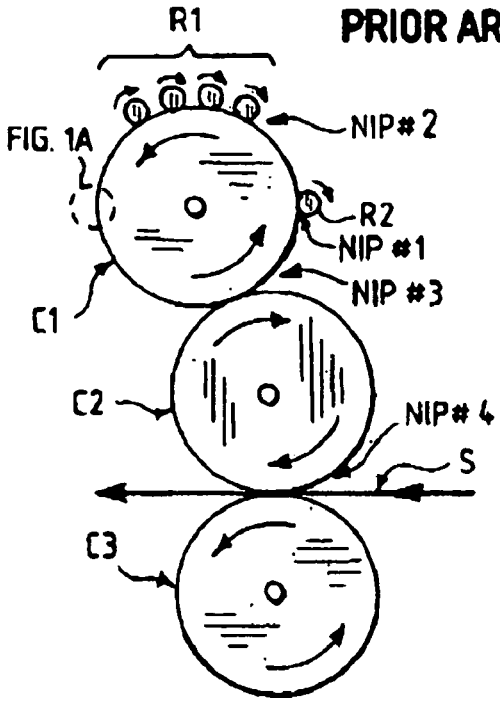
FIG. 1 PRIOR ART
FIG. 1 is an elevational view of a prior art litho print station.
Figure 1A:
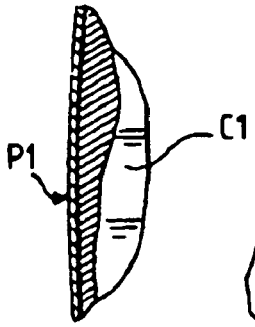
FIG. 1A PRIOR ART
FIG. 1A shows a magnified, fragmentary view in partial section of a portion of the prior art print cylinder shown in FIG. 1, with the outer print surface and part of the print cylinder shown in section.

FIG. 1 shows a prior art litho print station having a liquid-feeding roller R2 wetting with a water based fountain-solution the counter-clockwise rotating cylinder C1 as best shown in FIG. 1A carrying a liquid receiving and an ink receiving outer layer. As previously indicated, this outer layer is pre-treated to keep ink off the wetted—i.e., non-image (void)—areas. To this end, at a nip #1 between a water base-applying roller R2 and the outer layer P1 of the cylinder C1, water is transferred to the layer P1 of the cylinder C1 which then moves to nips #2 beneath rollers R1. The rollers R1 apply ink at the nips #2 to the layer P1, which then selectively adheres to the treated portions of the layer P1. The counter-clockwise rotating cylinder C1 then carries the ink on the surface of the layer P1 to a nip #3 at the periphery of a clockwise rotating cylinder C2 called a blanket cylinder moving at the same peripheral speed as the cylinder C1. The blanket cylinder then carries the ink to a nip #4 between the blanket of the cylinder C2 and the substrate S passing between the cylinder C2 periphery and the periphery of a counter-clockwise rotating cylinder C3 called the impression cylinder.

Figure 2A:
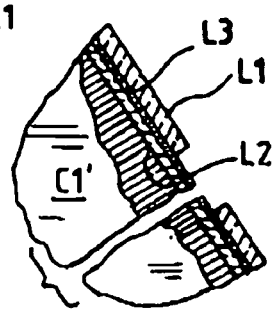
FIG. 2A shows a magnified, fragmentary view of a portion of one of the cylinders C1' shown in FIG. 2 with the multi-layered "Mike Plate" attached to the outer surface of the cylinder C1'.
Figure 2:
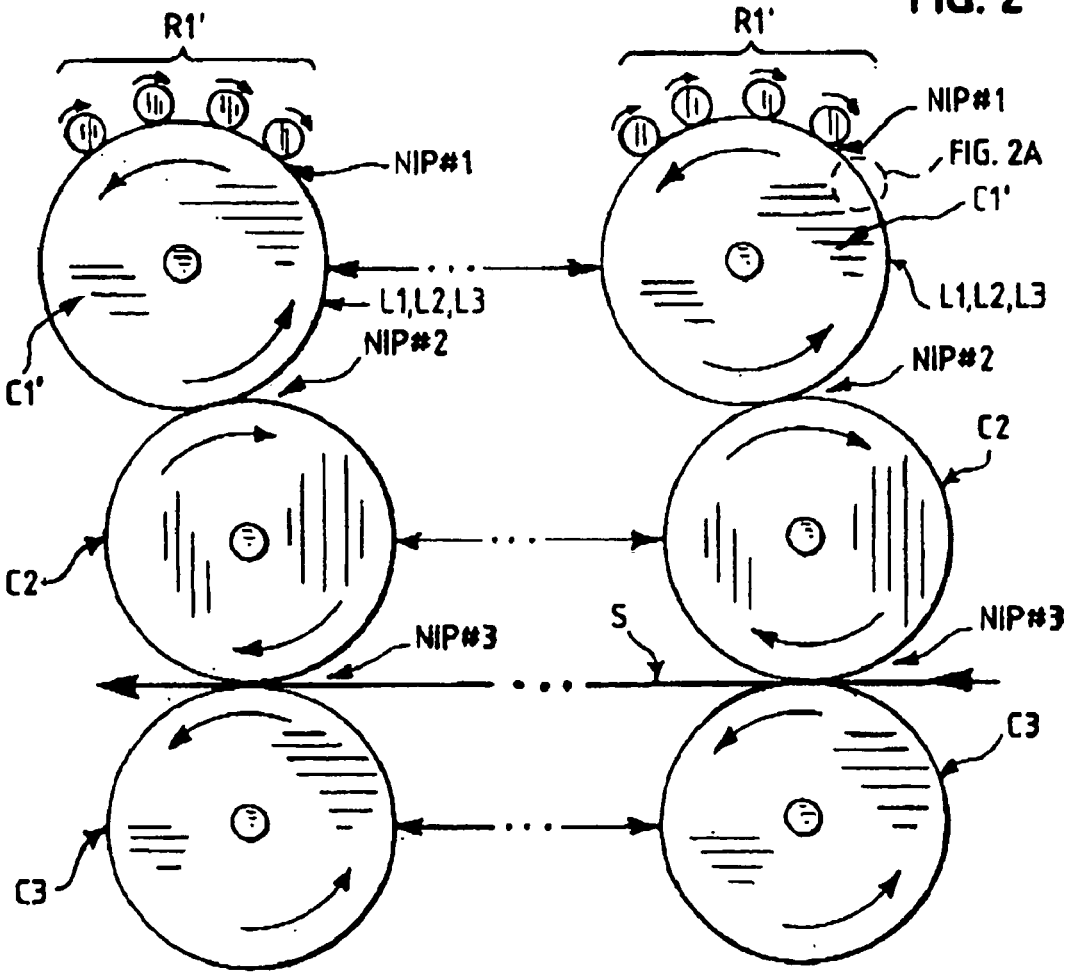
FIG. 2 is an elevational view of two novel spaced print stations of the present invention where the first cylinder C1' of each station carries a unique "Mike Plate" forming portion L1, L2, L3 having an outer layer L1 which is cut along a cut-pattern prior to or after its attachment to the cylinder C1' and where the resulting raised ink-receiving portions thereof will transfer ink to a blanket cylinder C2 which imprints the substrate S, the stations printing different colors and/or areas of the substrate.

Usually all of the stations of a prior art litho printing stations are like that shown in FIG. 1 where ink is imprinted on the substrate in different colors on the various press stations by the litho or other referred to press types. In the present invention as previously indicated, one or more of the print stations uniquely use a "Mike Plate" or "Mike Plate"-like multi-layered ink-applying outer portion previously used only to apply coatings over printed areas of the substrate. It was discovered that such a "Mike Plate," used to apply ink rather than coatings to areas of the substrate not then having letters, makes applying such areas in a simpler and more economical manner. FIG. 2 shows two spaced "Mike Plate" carrying stations used to apply to different areas of the substrate patterns of color of various shapes and sizes which may or may not be overprinted with letters using conventional print stations. Each of these stations have three rotating cylinders C1', C2 and C3 which are respectively "Mike Plate"-carrying, blanket and impressions cylinders. The blanket and impression cylinders C2 and C3 are like those described in connection with Figures C2 and C3. The "Mike Plate" layers L1, L2, an L3 on cylinder C1' are best shown in FIG. 2A. The outer layer L1 is preferably a translucent, but could be a transparent, layer of the material described in the "Summary of Invention." The outer Layer L1 is secured to a preferably transparent, but could be translucent, inner layer L2 shown in FIGS. 2 and 2A by a thin adhesive (layer L3). Before being attached to the periphery of the cylinder C1', the layers L1, L2 and L3, which are flexible, are placed upon a flat table top shown in FIG. 3 over a template T1 which has a cut pattern visible through the various layers L1, L2 and L3; so that a person can with a knife follow cut lines imprinted on the template to remove from the outer layer L1 areas of the transparent outer layer L1 to leave only those portions of the outer layer L1 which are to imprint the substrate S with the color desired to be imprinted. These areas could also be removed using a programmable computer-controlled machine with a cutting edge. This operation may obviate the need for the use of a template. After the outer layer L1 is so cut, the resulting structure is secured by clamps, not shown, to a portion of the cylinder C1' which is not carrying out a printing function.

As shown in FIG. 2, a series of ink-applying rollers R1 apply ink in the nip #1 areas to the uncut, raised portions of the outer layer L1 carried on the counter-clockwise rotating cylinder C1', which transfers the ink in a nip #2 to the surface of the blanket cylinder C2 rotating in the opposite direction but at the same peripheral speed as the impression cylinder C3, where at nip #3 the blanket cylinder C2 transfers the ink color involved to the desired areas of the substrate S.

Figure 3:
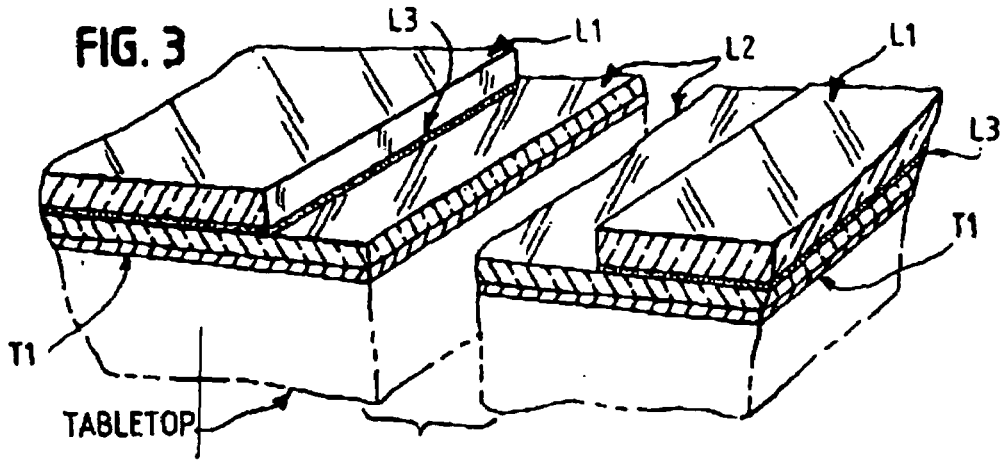
FIG. 3 is a fragmentary perspective view of one of the "Mike Plates" shown in FIG. 2 before it is attached to one of the cylinders C1' and where it is placed on a horizontal table top above a template T1 visible through the layers L1, L2 and L3 so that the outer layer L1 can be cut to or near the surface of the lower layer L2 to form cut-away portions of the outer layer L1 which receive ink which ultimately imprints upon the substrate S shown in FIG. 2.

FIG. 3 shows that under layer L2 is a template T1, which guides the manual cutting of layer L1. This template is not needed in FIG. 4, since the imaged opaque metal serves as its own template.

Figure 4:
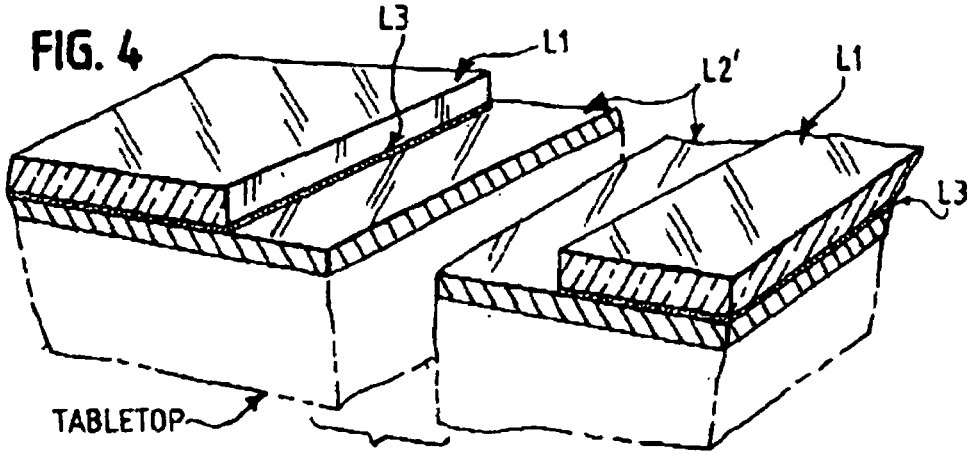
FIG. 4 shows a modified form of the "Mike Plate" which can replace the plate shown in FIGS. 2 and 3 where no template is used to outline the cut-away areas and where instead the lower layer L2' is opaque and is imaged so that the preferably see-through outer and central Layers L1 and L3 can preferably be manually severed along cut lines seen on the imaged lower layer, L2', or automatically by a programmable computer-controlled cutting machine.

FIG. 4 shows a variation of the "Mike Plate" shown in FIGS. 2, 2A and where the transparent or translucent inner layer L2 is replaced by what could be an opaque inner layer L2' having cut pattern thereon visible through the outer and middle layers L1 and L3 so that a person can manually form the cut-out areas if desired or by using a computer controlled cutting machine to do so.

Figure 5:
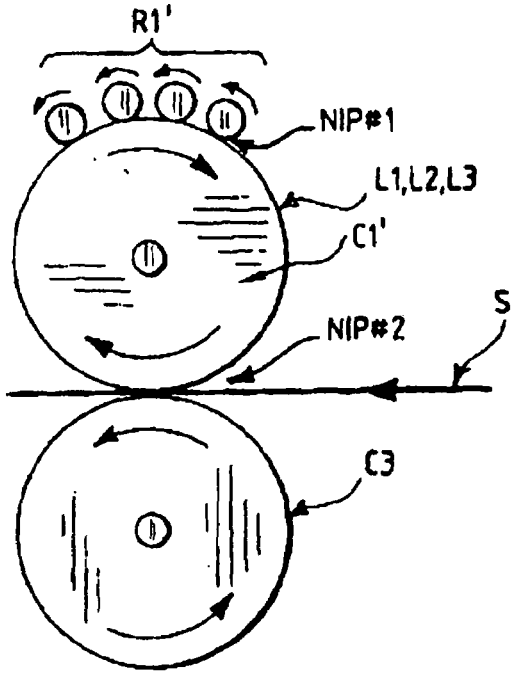
FIG. 5 is a fragmentary view through a modified print station where the C' cylinder-carried "Mike Plate" L1, L3 and L2 or L2' prints directly upon the substrate S which moves to other print stations including a flexographic printing station having a print cylinder C1' imprinting directly upon the substrate S backed by an impression cylinder C3.

Refer now to FIG. 5 which shows the use of a "Mike Plate"-carrying cylinder C1' directly imprinting upon the substrate S passing between the print cylinder C1' and an impression cylinder C3. FIG. 5 also shows a printing system using flexographic printing stations, like the one shown, to apply letters between or upon the colored areas imprinted by the "Mike Plate" carrying cylinders involved. As shown, an ink roller R1, applies ink to the raised portions of the print cylinder C1". The print cylinder C1" directly prints upon the substrate S passing between the oppositely rotated cylinders C1" and C3.

SUMMARY OF SOME OF THE FEATURES AND ADVANTAGES OF THE INVENTION

1. The elimination of fountain solution on a lithographic printing press station, via the use of a "Mike Plate"—a heterogeneous, 3-layer laminate printing plate, at low cost.
2. Said 3-layer, non-planar printing plate to consist of more than one layer.
3. Where the favored non-planar printing plate consists of three layers—a carrier layer and an applicator layer securely mounted to the carrier with an adhesive layer in the image areas of the printing form; all selected for durability, performance, adaptability to current pre-press equipment and procedures, or a programmable computer-controlled machine with a cutting edge and low cost.
4. Where the favored carriers are (1) transparent polyester plastic, preferably in the 0.004–0.020" caliper range, ideally 0.010', or (2) imagable metal, preferably in the 0.008–0.020" caliper range, ideally 0.012".
5. Where the favored applicator layer is a translucent or transparent plastic, preferably in the 0.015–0.050" caliper range, ideally 0.020", easily adhered with an adhesive to the carrier layer, characterized by the combination of durability, ease of transfer of ink thereon to a printing blanket and thence to the substrate, or directly onto the substrate if the litho press design and construct so permit, plus quick and easy replacement if damaged on-press, all at low cost.
6. Where the said 3-layer printing plate is prepared in the printing plant off-press, most advantageously manually in the pre-press department with standard pre-press equipment and procedures, or by machine with a programmable computer-controlled cutting edge, thereby adding little or no extra cost for preparation, and with the possibility that the printing plate for Job 2 will be ready and press-side before Job 1 comes off the press, with attendant little to no press downtime during a job change.
7. Where said 3-layer heterogeneous printing plate minimizes waste and press downtime and reduces the need for reruns caused by color variation in all colors from densitometer specifications, initial color okay, and customer disapproval.
8. Where said 3-layer heterogeneous printing plate reduces the number of nips on a print station from four to three via indirect transfer of ink to the substrate, and from three to two via direct transfer of ink to the substrate.
9. Where said 3-layer printing plate increases productivity of the press via decreased waste and unscheduled press downtime, and the prevention of job reruns caused by customer rejections based on color variation—i.e. the absence of print fidelity.
10. Where said 3-layer printing plate creates more vibrant colors than achievable by conventional lithography using fountain solution, at the same ink weight and film thickness.
11. Where said 3-layer printing plate results in lower ink costs per job than is typically possible with conventional lithography, via achievement of densitometer specification for any color with less ink. A tributary benefit is this encourages the printer to buy each color ink on per area cost, rather than price per pound.

12. The use of a "Mike Plate" to create a simplified, direct printing litho press design and construct, via elimination of the blanket cylinder and the creation of two nips per print station versus the four nips necessary in conventional planar litho print plate presses having fountain solution and blanket cylinder.

13. The use of a "Mike Plate," preferably a transparent polyester carrier, 0.004"–0.014" ideally 0.010" or 0.007", and a translucent or transparent applicator, 0.020" preferred, securely adhered onto the carrier in the image areas of letterpress, flexo, gravure, and webfed litho printing presses.

14. Where the "Mike Plate" is flexible, so as a body it can be curled around and mounted on the print cylinder of a printing press.

I claim:

1. A litho printing press comprising:

at least one printing station having:

an ink fountain having a supply of paste-type oil-based litho ink;

applicator roller means located adjacent the ink fountain for receiving ink from the fountain;

a rotatable plate cylinder located adjacent the ink fountain and the applicator roller means;

the plate cylinder having secured thereto a non-planar, multiple layer, flexible printing plate called a "Mike Plate" or "Modified Mike Plate", the multiple layer flexible printing plate comprising an outermost applicator layer which receives the paste-type oil based ink from the ink fountain via the applicator roller means, and an innermost carrier layer of a different material than the outermost layer, the outermost applicator layer being adhesively secured to the innermost carrier layer by a transparent adhesive, the outermost layer including spaced cut-out segments and adjacent projecting portions, the projecting portions forming image areas which receive the litho ink from the applicator roller means;

a rotatable impression cylinder over which a substrate passes and located adjacent the plate cylinder and forming a nip therewith;

wherein the projecting portions of the multiple layer printing plate on the plate cylinder deposit the paste-type oil-based litho ink thereon directly upon desired areas of the substrate held in contact with the projecting portions in the nip between the impression cylinder and plate cylinder, there being no blanket cylinder, dampener or dampening solution in the printing station to complicate the litho press construct or operation.

2. The litho press of claim 1 wherein all the layers of the multiple-layer flexible printing plate are transparent layers.

3. The litho press of claim 1, wherein the outermost applicator layer of the multiple layer flexible printing plate is transparent and the innermost carrier layer of the multiple layer flexible printing plate is opaque.

4. A method for printing paste-type oil-based litho ink with a litho printing press on a substrate which comprises the steps of:

producing a "Mike Plate" or "Modified Mike Plate" in a pre-press department of a printing plant by assembling a multiple layer flexible printing plate, the printing plate being composed of an outermost transparent layer for receiving and applying the paste-type oil-based litho ink in appropriate nips, the transparent outermost layer being adhesively secured by a transparent adhesive to an innermost carrier layer of a different material, the printing plate being assembled by placing the layers of the printing plate on a support surface, with the outermost layer on top, and cutting through only the outermost layer along a cut-pattern to create litho ink receiving and applying projections on the outermost layer; and providing a litho printing press with an ink fountain having a supply of paste-type oil-based litho ink and ink applicator means to convey the paste-type oil-based litho ink received from the ink fountain and depositing the litho ink on the projections of the multiple layer flexible printing plate secured to a rotatable plate cylinder, and which in turn deposits the litho ink directly onto a substrate held in contact with the plate cylinder in a nip by a rotatable impression cylinder, there being no blanket cylinder, dampener, or dampening solution needed in the litho press to complicate the litho press construct or operation.

5. The method of claim 4, wherein both the outermost layer and the innermost carrier layer of the multiple layer flexible printing plate are comprised of transparent synthetic plastic and the cutting is manually conducted on the outermost layer by following the cut pattern on a template positioned under the transparent innermost carrier layer adhesively secured to the outermost layer by the transparent adhesive.

6. The method of claim 4, wherein the outermost layer of the multiple layer flexible printing plate is comprised of transparent synthetic plastic and the innermost carrier layer of the multiple layer flexible printing plate is comprised of an opaque material and includes an imaged cut pattern, and the cutting is manually conducted on the outermost layer following the cut pattern provided on the innermost carrier layer which is secured to the outermost layer by the transparent adhesive.

7. The method of claim 4, wherein the cutting through the outermost layer of the multiple layer flexible printing plate is performed by a programmable automatic cutting machine called a CAD-CAM having a cutting edge which cuts through the outermost layer to produce the "Mike Plate" or "Modified Mike Plate".

8. The method of claim 4, wherein the thickness of the outermost layer of the multiple layer flexible printing plate is in the range of 0.015 inches to 0.050 inches.

9. The method of claim 4, wherein the thickness of the transparent adhesive is about 0.001 inches.

10. The method of claim 4, wherein the transparent adhesive is pressure-sensitive, and is pre-applied to the bottom surface of the outermost layer before the outermost layer arrives in the pre-press department of the printing plant.

11. The method of claim 4, wherein the thickness of the innermost carrier layer is in the range of about 0.004 inches to 0.020 inches.

12. The method of claim 4, wherein the total thickness of the "Mike Plate" or "Modified Mike Plate" is about 0.030 inches.

13. A litho printing press comprising:

at least one printing station having:

an ink fountain having a supply of paste-type oil-based litho ink;

applicator roller means located adjacent the ink fountain for receiving ink from the fountain;

a rotatable plate cylinder located adjacent the ink fountain and the applicator roller means;

the plate cylinder having secured thereto a non-planar, multiple layer, flexible printing plate called a "Mike Plate" or "Modified Mike Plate", the multiple layer flexible printing plate comprising an outermost applicator layer which receives the paste-type oil based ink from the ink fountain via the applicator roller means, and an innermost carrier layer of a different material than the outermost layer, the outermost applicator layer being adhesively secured to the innermost carrier layer by a transparent adhesive, the outermost layer including spaced cut-out segments and adjacent projecting portions, the projecting portions forming image areas which receive the litho ink from the applicator roller means;

a rotatable blanket cylinder with a blanket thereon and located adjacent the plate cylinder and forming a nip therewith; and a rotatable impression cylinder over which a substrate passes and located opposite the blanket cylinder and forming a nip therewith;

wherein, in the nip between the blanket cylinder and plate cylinder, the blanket cylinder receives the litho ink from the projections of the multiple layer flexible printing plate secured to the plate cylinder, and in turn the blanket cylinder deposits the litho ink upon desired areas of the substrate passing through the nip between the blanket cylinder and the impression cylinder, there being no dampening solution or dampener in the printing station to complicate the litho press construct or operation.

14. The litho press of claim 13 wherein all the layers of the multiple layer flexible printing plate are transparent layers.

15. The litho press of claim 13, wherein the outermost applicator layer of the multiple layer flexible printing plate is transparent and the innermost carrier layer of the multiple layer flexible printing plate is opaque.

16. A method for printing paste-type oil-based litho ink with a litho printing press on a substrate which comprises the steps of:

producing a "Mike Plate" or "Modified Mike Plate" in a pre-press department of a printing plant by assembling a multiple layer flexible printing plate, the printing plate being composed of an outermost transparent layer for receiving and applying the paste-type oil-based litho ink in appropriate nips, the transparent outermost layer being adhesively secured by a transparent adhesive to an innermost carrier layer of a different material, the printing plate being assembled by placing the layers of the printing plate on a support surface, with the outermost layer on top, and cutting through only the outermost layer along a cut-pattern to create litho ink receiving and applying projections on the outermost layer; and providing a litho printing press with an ink fountain having a supply of paste-type oil based litho ink and ink applicator means to convey the paste-type oil-based litho ink received from the ink fountain and depositing the litho ink on the projections of the multiple layer flexible printing plate secured to a rotatable plate cylinder, said plate cylinder in turn depositing the litho ink received from the projections onto a blanket mounted on a rotatable blanket cylinder, which in turn deposits the litho ink onto a substrate held in contact with the blanket cylinder in a nip formed between a rotatable impression cylinder and the blanket cylinder, there being no dampening solution or dampener used in the litho press to complicate the litho press construct or operation.

17. The method of claim 16, wherein both the outermost layer and the innermost carrier layer of the multiple layer flexible printing plate are comprised of transparent synthetic plastic and the cutting is manually conducted on the outermost layer by following the cut pattern on a template positioned under the transparent innermost carrier layer adhesively secured to the outermost layer by the transparent adhesive.

18. The method of claim 16, wherein the outermost layer of the multiple layer flexible printing plate is comprised of transparent synthetic plastic and the innermost carrier layer of the multiple layer flexible printing plate is comprised of an opaque material and includes an imaged cut pattern, and the cutting is manually conducted on the outermost layer following the cut pattern provided on the innermost carrier layer which is secured to the outermost layer by the transparent adhesive.

19. The method of claim 16, wherein the cutting through the outermost layer of the multiple layer flexible printing plate is performed by a programmable automatic cutting machine called a CAD-CAM having a cutting edge which cuts through the outermost layer to produce the "Mike Plate" or "Modified Mike Plate".

20. The method of claim 16, wherein the thickness of the outermost layer of the multiple layer flexible printing plate is in the range of 0.015 inches to 0.050 inches.

21. The method of claim 16, wherein the thickness of the transparent adhesive is about 0.001 inches.

22. The method of claim 16, wherein the transparent adhesive is pressure-sensitive, and is pre-applied to the bottom surface of the outermost layer before the outermost layer arrives in the pre-press department of the printing plant.

23. The method of claim 16, wherein the thickness of the innermost carrier layer is in the range of about 0.004 inches to 0.020 inches.

24. The method of claim 16, wherein the total thickness of the "Mike Plate" or "Modified Mike Plate" is about 0.030 inches.

* * * * *